US011142954B2

(12) United States Patent
Bayliss

(10) Patent No.: US 11,142,954 B2
(45) Date of Patent: Oct. 12, 2021

(54) PAD IN BIT ARTICULATED ROTARY STEERABLE SYSTEM

(71) Applicant: Schlumberger Technology Corporation, Sugar Land, TX (US)

(72) Inventor: Martin Thomas Bayliss, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/259,422

(22) Filed: Jan. 28, 2019

(65) Prior Publication Data

US 2019/0153784 A1 May 23, 2019

Related U.S. Application Data

(62) Division of application No. 14/875,770, filed on Oct. 6, 2015, now Pat. No. 10,221,627.

(60) Provisional application No. 62/064,408, filed on Oct. 15, 2014.

(51) Int. Cl.

| | |
|---|---|
| ***E21B 17/10*** | (2006.01) |
| ***E21B 47/024*** | (2006.01) |
| ***E21B 7/06*** | (2006.01) |
| ***E21B 7/04*** | (2006.01) |
| ***E21B 17/20*** | (2006.01) |

(52) U.S. Cl.

CPC ..... *E21B 7/061* (2013.01); *E21B 7/04* (2013.01); *E21B 7/06* (2013.01); *E21B 7/068* (2013.01); *E21B 17/1078* (2013.01); *E21B 17/20* (2013.01); *E21B 47/024* (2013.01)

(58) Field of Classification Search

CPC ... E21B 7/061; E21B 7/04; E21B 7/06; E21B 17/1078; E21B 47/024

See application file for complete search history.

(56) References Cited

U.S. PATENT DOCUMENTS

| | | | | |
|---|---|---|---|---|
| 6,438,495 | B1 * | 8/2002 | Chau | E21B 47/022 702/9 |
| 7,228,918 | B2 | 6/2007 | Evans et al. | |
| 8,302,705 | B2 | 11/2012 | Downton | |
| 8,672,056 | B2 | 3/2014 | Clark et al. | |

(Continued)

FOREIGN PATENT DOCUMENTS

| | | | |
|---|---|---|---|
| WO | 2014011463 | A1 | 1/2014 |
| WO | 2014160567 | A1 | 10/2014 |

OTHER PUBLICATIONS

Panchal, N. et al.; Robust Linear Feedback Control of Attitude for Directional Drilling Tools; Aug. 2010; All (Year: 2010).*

(Continued)

*Primary Examiner* — Benjamin F Fiorello

(57) ABSTRACT

A rotary steerable system (RSS) including an upper stabilizer connected to a collar of a drill string, an articulated section connected by a flexible joint to the collar, a drill bit connected to the articulated section opposite from the flexible joint, a lower stabilizer located proximate to the flexible joint and an actuator located with the articulated section and selectively operable to tilt an axis of the drill bit and the articulated section relative to the collar. A method includes drilling with the RSS a bias phase of a drilling cycle on a demand tool face and drilling a neutral phase of the drilling cycle on a 180 degree offset tool face from the demand tool face.

8 Claims, 5 Drawing Sheets

(56) References Cited

U.S. PATENT DOCUMENTS

| | | | | |
|---|---|---|---|---|
| 8,875,806 | B2 | 11/2014 | Williams | |
| 8,967,296 | B2 | 3/2015 | Downton et al. | |
| 9,022,141 | B2 | 5/2015 | Panchal et al. | |
| 9,371,696 | B2 | 6/2016 | Oppelaar | |
| 9,835,020 | B2 | 12/2017 | Bayliss et al. | |
| 10,472,893 | B2 * | 11/2019 | Benson | E21B 7/06 |
| 2003/0010534 | A1 * | 1/2003 | Chen | E21B 7/067 175/61 |
| 2003/0121702 | A1 | 7/2003 | Downton et al. | |
| 2007/0029113 | A1 * | 2/2007 | Chen | E21B 7/04 175/45 |
| 2007/0251726 | A1 | 11/2007 | Menger | |
| 2008/0083567 | A1 | 4/2008 | Downton et al. | |
| 2009/0000823 | A1 * | 1/2009 | Pirovolou | E21B 7/04 175/61 |
| 2009/0065258 | A1 * | 3/2009 | Hamilton | E21B 7/06 175/61 |
| 2009/0266610 | A1 * | 10/2009 | Farley | E21B 47/022 175/45 |
| 2013/0000980 | A1 * | 1/2013 | Dolgin | E21B 44/00 175/45 |
| 2013/0199844 | A1 | 8/2013 | Bayliss et al. | |
| 2014/0291024 | A1 | 10/2014 | Sugiura et al. | |
| 2015/0330209 | A1 * | 11/2015 | Panchai | E21B 7/04 700/275 |
| 2016/0108679 | A1 | 4/2016 | Bayliss | |
| 2016/0186551 | A1 * | 6/2016 | Dykstra | E21B 47/02 175/24 |
| 2017/0306702 | A1 * | 10/2017 | Summers | E21B 44/02 |
| 2018/0003026 | A1 * | 1/2018 | Boone | E21B 44/02 |

OTHER PUBLICATIONS

International Search Report and Written Opinion issued in International Patent application PCT/US2015/055079 dated Jan. 22, 2016, 14 pages.

International Preliminary Report on Patentability issued in International Patent application PCT/US2015/055079 dated Apr. 18, 2017, 10 pages.

* cited by examiner

PAD IN BIT ARTICULATED ROTARY STEERABLE SYSTEM

CROSS-REFERENCE TO RELATED APPLICATIONS

This application is a divisional application of U.S. patent application Ser. No. 14/875,770, filed on Oct. 6, 2015, which claims priority to and the benefit of US Provisional Application No. 62/064,408, filed on Oct. 15, 2014, the entire contents of both of which are hereby incorporated by reference herein.

BACKGROUND

This section provides background information to facilitate a better understanding of the various aspects of the disclosure. It should be understood that the statements in this section of this document are to be read in this light, and not as admissions of prior art.

An oil or gas well often has a subsurface section that is drilled directionally, i.e., inclined at an angle with respect to the vertical and with an inclination having a particular compass heading or azimuth. A typical procedure for drilling a directional wellbore is to remove the drill string and drill bit by which the initial, vertical section of the well was drilled using conventional rotary drilling techniques, and run in a mud motor having a bent housing at the lower end of the drill string which drives the bit in response to circulation of drilling fluid. The bent housing provides a bend angle such that the axis below the bend point, which corresponds to the rotation axis of the bit, has an inclination with respect to the vertical.

A "toolface" angle with respect to a reference, as viewed from above, is established by slowly rotating the drill string and observing the output of various orientation devices until the desired azimuth or compass heading is reached. The mud motor and drill bit are then lowered (i.e., the weight of the drill string is loaded onto the drill bit) with the drill string non-rotatable to maintain the selected toolface, and the drilling fluid pumps are energized to develop fluid flow through the drill string and mud motor. The mud motor converts the hydraulic energy of the drilling fluid into rotary motion of a mud motor output shaft that drives the drill bit. The presence of the bend angle causes the bit to drill on a curve until a desired borehole inclination has been established. Once the desired inclination is achieved at the desired azimuth, the drill string is then rotated so that its rotation is superimposed over that of the mud motor output shaft, which causes the bend section to merely orbit around the axis of the borehole so that the drill bit drills straight ahead at whatever inclination and azimuth have been established.

Various problems can arise when sections of the wellbore are being drilled with a mud motor and the drill string is not rotating. The reactive torque caused by operation of a mud motor can cause the toolface to gradually change so that the borehole is not being deepened at the desired azimuth. If not corrected, the wellbore may extend to a point that is too close to another wellbore, the wellbore may miss the desired subsurface target, or the wellbore may simply be of excessive length due to "wandering." These undesirable factors can cause the drilling costs of the wellbore to be excessive and can decrease the drainage efficiency of fluid production from a subsurface formation of interest. Moreover, a non-rotating drill string will cause increased frictional drag so that there is less control over the "weight on bit" and the rate of drill bit penetration can decrease, which can also result in substantially increased drilling costs. Of course, a non-rotating drill string is also more likely to get stuck in the wellbore than a rotating one, particularly where the drill string extends through a permeable zone that causes significant buildup of mud cake on the borehole wall.

Rotary steerable drilling systems minimize these risks by steering the drill string while it's being rotated. Rotary steerable systems, also known as "RSS," may be generally classified as either "push-the-bit" systems or "point-the-bit" systems.

SUMMARY

In accordance to an aspect of the disclosure a rotary steerable system includes an upper stabilizer connected to a collar of a drill string, an articulated section connected by a flexible joint to the collar, a drill bit connected to the articulated section opposite from the flexible joint, a lower stabilizer located proximate to the flexible joint and an actuator located with the articulated section and selectively operable to tilt the axis of the drill bit and the articulated section relative to the axis of the collar. A method in accordance to an embodiment includes drilling a borehole with the rotary steerable system including drilling a bias phase of a drilling cycle on a demand tool face and drilling a neutral phase of the drilling cycle on a 180 degree offset tool face from the demand tool face. In accordance to an embodiment a method includes estimating an optimum drilling cycle time and performing a drilling cycle using the estimated optimum drilling time with the rotary steerable system.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
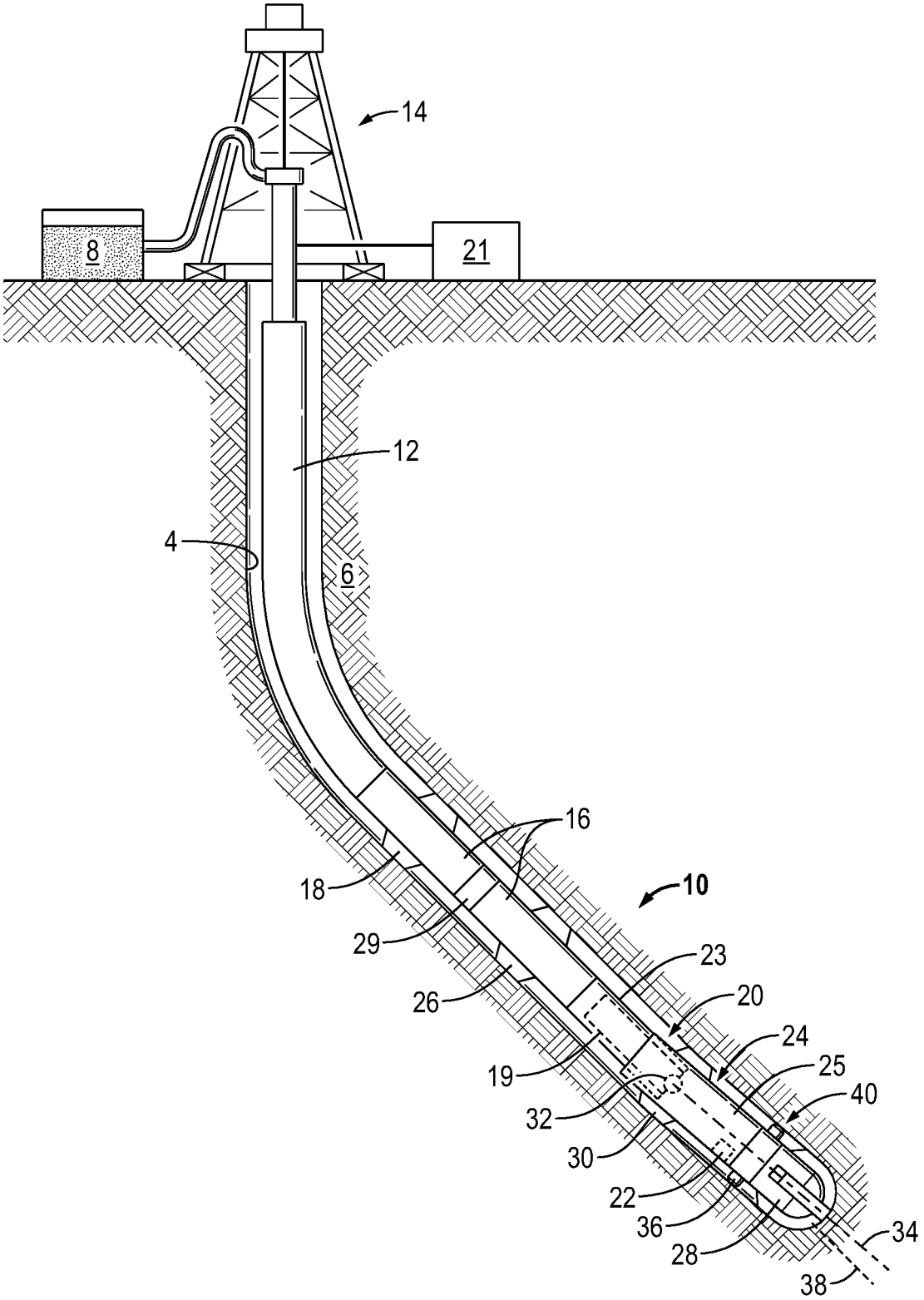
FIG. 1 illustrates a well system incorporating a rotary steerable system ("RSS") having a pad-in-bit articulated section bias unit in accordance to one or more aspects of the disclosure.
Figure 1A:
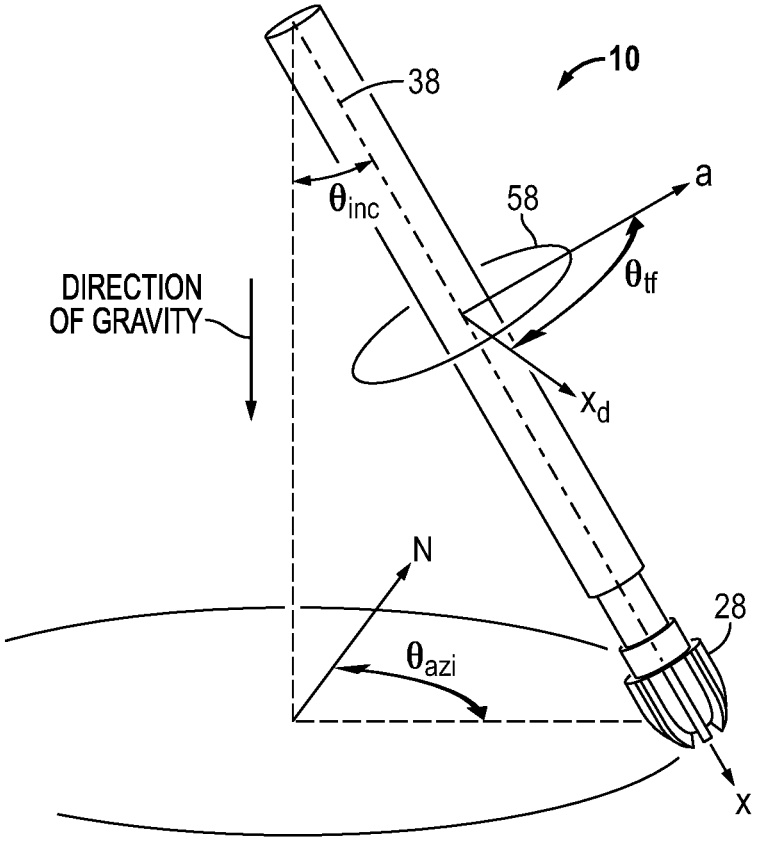
FIG. 1A is a pictorial diagram of attitude and steering parameters depicted in a global coordinate reference in accordance to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

FIG. 1 illustrates borehole 4, or wellbore, being directionally drilled into earthen formations 6 utilizing a bottom hole assembly ("BHA"), generally denoted by the numeral 10. The bottom hole assembly is depicted connected to the end of the tubular drill string 12 which is may be rotatably driven by a drilling rig 14 from the surface. In addition to providing motive force for rotating the drill string 12, the drilling rig 14 also supplies a drilling fluid 8, under pressure, through the tubular drill string 12. In order to achieve directional control while drilling, components of the BHA 10 may include one or more drill collars 16, one or more stabilizers, generally denoted by the numeral 18, and a rotary steerable system ("RSS") 20. The rotary steerable system 20 is the lowest component of the BHA and in accordance to one or more embodiments includes a control unit 22, bias unit 40 and a steering section 24. Steering section 24 includes an upper collar or section 23 connected to a lower articulated section or member 25 by a flexible joint 32. The lower articulated section 25 is referred to from time to time herein as an articulated section, articulated member or other similar terms. Although the steering section 24 is described in terms of two sections, the sections may be integrally combined in one component. In accordance to embodiments disclosed herein, the BHA may be referred to as a pad-in-bit articulated BHA 10 and the RSS may be referred to as a pad-in-bit articulated RSS 20.

The upper collar or section 23 is connected to the last of the drill collars 16 or to any other suitable downhole component. Other components suited for attachment of the rotary steerable system 20 include a drilling motor 19 (e.g., mud motor), measuring while drilling tools, tubular segments, data communication and control tools, cross-over subs, etc. An upper stabilizer 26 is attached to one of the collars 16, for example above and adjacent to the rotary steerable system 20. A lower stabilizer 30 is located adjacent to the flexible joint 32 and in some embodiments it is located coincident with the flexible joint. In an embodiment, a lower stabilizer 30 is attached to the lower articulated section 25 of steering section 24. The steering section 24 also includes drill bit 28.

A surface control system 21, e.g., directional driller, may be utilized to communicate steering commands to the electronics in control unit 22, e.g. attitude hold controller, either directly in a manner that is well known in the art (e.g., mud-pulse telemetry) or indirectly via a measuring while drilling ("MWD") module 29 included among the drill collars 16. The lower articulated section 25 including the bit shaft and drill bit 28 are pivoted, as represented by a bit axis 34, relative to the axis 38 (e.g., drill attitude) of the bottom hole assembly 10 (e.g., the collar axis) by way of a flexible section or joint 32 within the steering section 24.

The flexible section or joint 32 may be provided for example by a universal joint. The flexible section or joint 32 itself may transmit the torque from the drill string 12 to the drill bit 28, or the torque may be transmitted via other arrangements. Suitable torque transmitting arrangements include many well-known devices such as splined couplings, gearing arrangements, universal joints, and recirculating ball arrangements. In accordance to aspects of the disclosure the flexible joint 32 may include for example a universal joint with a flex tube, a universal joint without a flex tube, or a flex sub with effectively zero moment transmission across it, such that the flexible joint has the functionality of a universal joint with two angular degrees of freedom whilst allowing for transmission of axial torque to the drill bit and transmitting a negligible bending moment across itself.

The lower articulated section 25 is intermittently actuated by one or more actuators 36, about the flexible section or joint 32 with respect to the upper collar or section 23 (collar or BHA axis 38) to actively maintain the bit axis 34 pointing in a particular direction while the whole assembly is rotated with the drill string. The term "actively tilted" is meant to differentiate how the rotary steerable system 20 is dynamically oriented as compared to the known fixed displacement units. "Actively tilted" means that the rotary steerable system 20 has no set fixed angular or offset linear displacement. Rather, both angular and offset displacements vary dynamically as the rotary steerable system 20 is operated.

The use of a universal joint as a flexible joint 32 swivel is desirable in that it may be fitted in a relatively small space and still allow the drill bit axis 34 to be tilted with respect to the axis 38 such that the direction of drill bit 28 defines the direction of the borehole 4. That is, the direction of the drill bit 28 leads the direction of the borehole 4. This allows for the rotary steerable system 20 to drill with little or no side force once a curve is established and minimizes the amount of active control necessary for steering the borehole 4. Further, the collar 16 can be used to transfer torque to the drill bit 28. This allows a dynamic point-the-bit rotary steerable system 20 to have a higher torque capacity than a static point-the-bit type tool of the same size that relies on a smaller inner structural member for transferring torque to the bit. Although the illustrated embodiments utilize a torque transmitting device) such as a universal joint as the flexible joint 32 in the steering section, other devices such as flex connections, splined couplings, ball and socket joints, gearing arrangements, etc. may also be used as a flexible joint 32.

Figure 2:
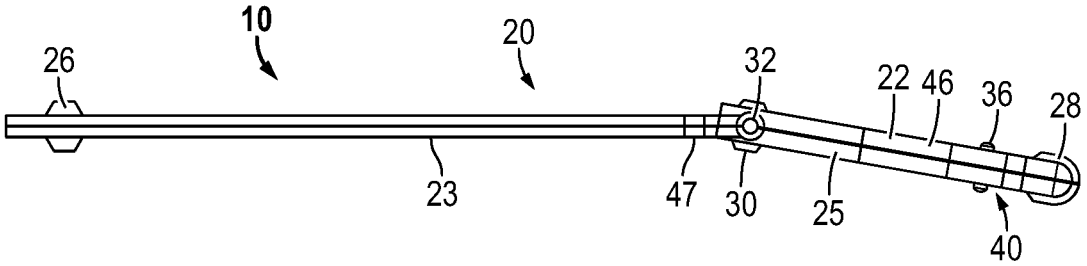
FIGS. 2 and 3 schematically illustrate an RSS in accordance to one or more aspects of the disclosure.
Figure 3:
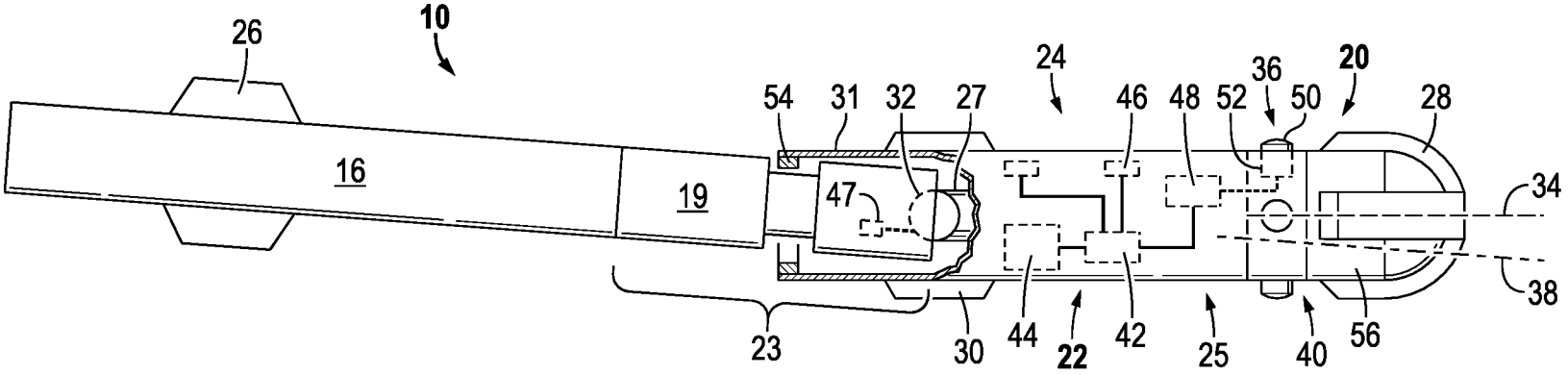

Refer now to FIGS. 2 and 3 which schematically illustrate a pad-in-bit articulated rotary steerable system 20 of a BHA 10 in accordance to one or more embodiments. The illustrated pad-in-bit RSS 20 includes a steering section 24 having an upper collar or section 23 connected by a flexible joint 32 to a lower articulated section 25 carrying a drill bit 28. For example, lower articulated section 25 includes the drill bit shaft 27 which is connected to the flexible joint 32 and an outer sleeve 31. In accordance to one or more aspects of the disclosure a lower stabilizer 30 is located on the upper section or collar 23 or the lower articulated section 25 proximate to and or below the flexible joint 32. Stabilizer 30 is illustrated located on the articulated section 25 for example in FIGS. 2 and 3. In accordance to embodiments, stabilizer 30 is located coincident or substantially coincident with the flexible joint 32; for example, within an inch or two inches of the flexible joint 32, e.g., universal joint. Locating the stabilizer 30 coincident with the flexible joint 32 stabilizes the flexible joint.

The drill bit shaft 27 may be connected for example to the rotor of a mud motor 19 for example through a flexible drive shaft. The control unit 22 may be for example a roll stabilized or strap down variety. Illustrated in FIGS. 2 and 3, the control unit 22 and the bias unit 40 are disposed directly behind and adjacent to drill bit 28 in the lower articulated section 25. The control unit 22 includes for example and without limitation self-powered electronics 42, an electrical source 44, sensor or sensors 46 (e.g., direction and azimuth sensors or sensor package, direction and inclination (D&I) sensors), and control valves 48. The bias unit 40 includes an actuator 36 to apply a radial force against the wall of the borehole. For example, the illustrated actuator 36 includes piston face or pad 50 disposed on moveable pistons 52. The pistons 52 may be moved from a retracted position toward an extended position by supplying drilling fluid to the piston cylinders. It will be recognized by those skilled in the art that the pistons may be oriented parallel to the bit axis and hinged to move pads 50 radially outward. The supply of the drilling fluid to the pistons is controlled by the control unit 22. To achieve a drilling direction, the control unit can actuate one or more of the pistons 52 to an extended position such that the pad 50 engages the wall of the borehole 4 and articulates the lower articulated section 25 and drill bit 28 at the flexible joint 32 relative to the axis 38 of the upper collar or section 23 and the drill string. In accordance to some embodiments, the control unit 22 for the bias unit may be located above the motor and the flexible joint 32 and the fluid under pressure flowing for example through a flexible drive shaft across the flexible joint 32 (e.g., universal joint) to the actuators 36.

The steering section 24 illustrated in FIG. 3 includes a strike ring 54 positioned to limit the angle or extent that the lower articulated section 25 can be articulated relative to the upper collar or section 23. The drill bit 28 has a bit gauge 56, for example active and/or passive gauge rings. The gauge is associated with the amount of formation that is removed from the borehole wall.

A pad-in-bit articulated RSS 20 in accordance to one or more aspects of the disclosure combines a bias unit 40 having a high dog-leg severity ("DLS") capability, for example of a point-the-bit tool, with the excellent attitude hold performance of conventional push-the-bit low DLS tools. In accordance to methods of the disclosure, the disclosed pad-in-bit articulated RSS can drill a build section and a lateral section, for example while geo-steering, without having to trip out of the wellbore to change steering tools, e.g., from a point-the-bit tool to a push-the-bit tool.

In accordance to some embodiments the pad-in-bit articulated RSS 20 does not need extra sleeve sensors or closed loop sleeve tool face control and can be steered very accurately with the basic 100 percent steering ratio virtual tool face ("VTF") with no attitude measurement feedback delay compensation algorithms. In accordance to some embodiments, the pad-in-bit articulated RSS 20 can perform high DLS parameters, e.g. greater than 15 degrees/100 ft., without sleeve "flipping" or large tool face offset issues. In accordance to some embodiments the pad-in-bit articulated RSS 20 is a low power tool with and fast tool face actuation. Utilizing a strike ring 54 may provide more predictable steady state DLS at 100 percent steering ratio, however, in some embodiments a strike ring is not used. In accordance to aspects, the pad-in-bit articulated RSS effectively becomes a push-the-bit tool when in the lateral, whilst having the benefits of a point-the-bit tool in a soft formation. Non-limiting examples of directional drilling control are described with reference to U.S. Pat. No. 9,022,141, which is incorporated by reference herein.

In accordance to one or more embodiments, the control unit 22 is positioned between the bend (flexible joint 32) and the drill bit 28 with the steering forces (actuator 36) applied as close to the bit 28 as possible with the reaction on the active gauge 56 of the drill bit 28 seeing as much of the steering (pad) forces as possible, i.e. a large or no under gauge bit. In accordance to an embodiment, the pad-in-bit articulated RSS 20 may have a drill bit 28 to flexible joint 32 dimension of about five feet to thirty feet. In accordance to an embodiment, the pad-in-bit articulated RSS may have a drill bit 28 to flexible joint 32 dimension of about ten feet to twenty feet. In accordance to at least one embodiment, the pad-in-bit articulated RSS may have a drill bit 28 to flexible joint 32 dimension of about fifteen feet. In accordance to an embodiment, the pad-in-bit articulated RSS 20 may have a drill bit to 28 to flexible joint 32 up to about four feet and a flexible joint 32 to stabilizer 26 dimension of up to about fifteen feet in accordance to the implied assumption of Equation 3 below.

The D&I sensors 46 are placed as close to the drill bit 28 as possible, for example in the lower articulated section 25, or the D&I sensors may be located above the flexible joint 32 for example in the upper collar or section 23 and connected to the control unit 22 in the articulated section 25 via wiring going through the flexible joint 32, e.g., universal joint, or by telemetry. D&I sensors, denoted as D&I sensors 47 or on-collar sensors, are illustrated in FIG. 3 located above the flex joint 32 relative to the drill bit. For the application of virtual tool face it may be desired to have the D&I sensors 46 in the articulated section 25 (FIG. 3) close to the drill bit. For example, in accordance to a simulation described below, the D&I sensor 46 were placed eight feet from the drill bit 28 in the articulated section 25 so as to mimic a PowerDrive (trademark of Schlumberger) RSS tool (see, e.g., Table 1 and FIG. 5).

Operationally, a roll stabilized control unit 22 once downlinked, e.g., using mud telemetry, to hold an attitude will stay in attitude hold with no electrical connection required to the rest of the pad-in-bit articulated BHA 10. This configuration can be useful as electrical connectivity past the flexible joint may be problematic and or complex and expensive.

Figure 4:
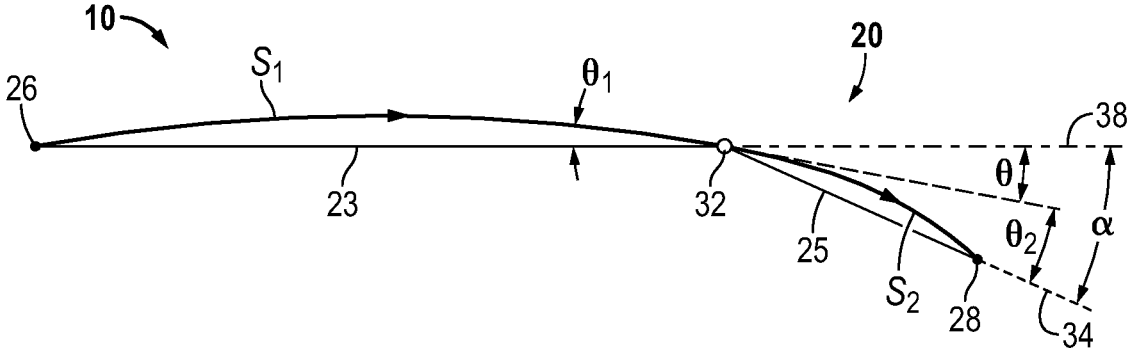
FIG. 4 illustrates a geometric relationship steady state curvature of a wellbore.

In accordance to aspects of the disclosure, the pad-in-bit articulated BHA 10 and RSS 20 has the advantages of a push-the-bit tool (low power fast tool face actuation) and it also has the advantages of a point-the-bit bias unit, implying a higher DLS capability (particularly in soft formations) but also an easier to predict steady state DLS capability using the following geometric relationship described with reference to FIG. 4. With reference to FIG. 4 the steady state curvature prediction of Eq. 3 is valid when the flexure of the bottom hole assembly between the drill bit 28 to flexible joint 32 section and the flexible joint 32 to stabilizer 26 section is negligible such the RSS 20 over these two dimensions can be treated as two rigid bodies linked by the flexible joint 32.

$$\theta_1 = \alpha - \theta_2 = \theta \quad \text{(Eq. 1)}$$

$$\frac{s_1\rho}{2} = \alpha - \frac{s_2\rho}{2} = \theta \quad \text{(Eq. 2)}$$

$$\rho = \frac{2\alpha}{(s_1 + s_2)} \quad \text{(Eq. 3)}$$

Where:

$S_1$, $S_2$ are the paths of the constant curvature between the contact points (can be taken as the chords between the contact points as a first approximation, i.e. the stabilizer position dimensions), $\alpha$ is the angle of limit for articulation of the articulated section 25 (e.g., the a strike ring angle), and $\rho$ is the steady state curvature of the wellbore between the first three contact points (the drill bit 28, the lower stabilizer 30, and the upper stabilizer 26).

Simulation Case Studies

Figure 5:
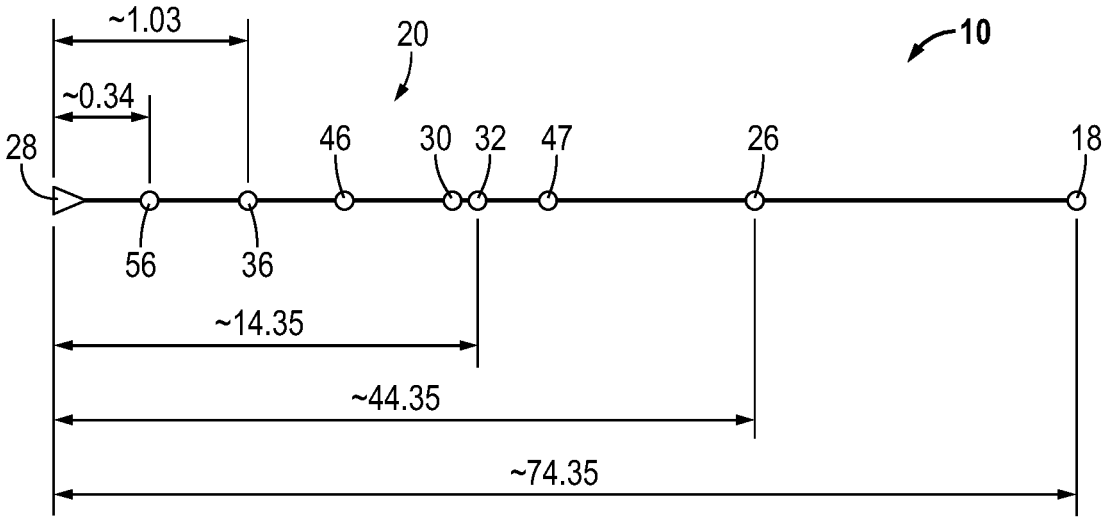
FIG. 5 illustrates model parameters for a simulation of a tool in accordance to one or more aspects of the disclosure.

Model parameters for a simulation of a pad-in-bit articulated BHA 10 and RSS 20 are illustrated in FIG. 5 (dimensions in feet) and Table 1 below. A model pad-in-bit articulated BHA 10 was made to drill due East with a gravity tool ("GTF") of 90 degrees. The model BHA proceeded to drill with a steady state DLS of 17 degrees/100 ft. or more with very little propagated hole tool face offset. It is noted that the analytical equation, Equation 3, stated above for predicting the steady state DLS of a point-the-bit tool predicted 16.4 degree/100 ft. curvature which is similar to the numerical simulation results. The response tool face of the propagated borehole had a consistent and small tool face offset that the directional driller could easily compensate for if manual steering were being used.

TABLE 1

| | |
|---|---|
| Actuator Force | 10 kN |
| Nominal RPM | 60 |
| Effective rate of penetration (ROP) | 100 ft/hr |
| Tool Size | 675 |
| Bit Model | Detourney plus passive gauge stabilizer |
| Tool to Formation CoF | 0.35 |
| Actuation tool face update interval | 0.5 seconds |
| D&I 46 to bit offset (D&I on lower articulated section 25) | 8 ft |
| D&I 47 to bit offset (MWD on upper collar or section 23) | 14 ft |
| Strike ring angle | 2 degrees |
| Initial azimuth and inclination | 90 degrees for both |

In the simulation the lower articulated section 25 was fully articulated at 2 degrees throughout the run and the magnitude of the contact force on the strike ring 54 was around 110 kN. The contact force on the strike ring will be higher on the steering section 24 of the pad-in-bit articulated RSS 20 of this disclosure compared to prior rotary steerable systems due to the greater moment arm of the longer articulated steering section 25 due to positioning of the bias unit 40 below the flexible joint 32.

Attitude Hold Study

In an attitude hold simulation the pad-in-bit articulated BHA 10 and RSS 20 was started from the same initial conditions as the above simulation, but put into VTF attitude hold immediately. The simulation tool was able to hold the demand attitude with a tolerance of 0.25 degrees throughout the simulation run. This demonstrates that the pad-in-bit articulated BHA 10 and RSS 20 can be predicted to have the high DLS capability of a point-the-bit tool but with the excellent VTF attitude hold capability demonstrated by lower dogleg severity tools using the same VTF algorithm. The simulated pad-in-bit articulated BHA 10 demonstrated excellent attitude hold response when drilling in VTF and was also capable of greater than 17 degrees/100 ft. in pure bias (100 percent steering ratio) as described above.

In the simulation, the tool face response was determined for attitude measurements of both the on tool D&I sensors 46 located on the articulated section 25 and the on-collar D&I sensor 47, e.g., MWD, located on the upper section 23 (i.e., collar). Also of interest is that the on tool D&I sensor 46, i.e. the D&I sensor 46 on the articulated section 25, picked up on the ±2 degrees of articulation. Despite the VTF algorithm using the attitude measurements from the articulated effected lower section 25, the attitude response of the resulting borehole, as measured by the on-collar D&I sensor 47 that is fourteen feet further back on the collar from the drill bit, demonstrated an excellent attitude tracking response with a small attitude tolerance. This was achieved while filtering the on tool D&I 46 attitude measurement with an equivalent of a 1 Hz band width analogue low pass filter, other D&I and signal conditioning architectures are possible.

Attitude Hold with a Nudge Study

This case study is the same as above but instead of maintaining the same demand attitude throughout a nudge of +2 degrees inclination was downlinked at 80 feet of measured depth. The modeled pad-in-bit articulated BHA 10 and RSS 20 accurately followed the demand attitude whilst clearly uncoupling the inclination from the azimuth response as would be expected in VTF for a tool with fast tool face actuation. This kind of precision and control is unexpected in particular with such a simple attitude hold algorithm. In this simulation the strike ring 54 was mostly not in contact during the attitude hold and only came into contact briefly during the nudge transient.

Vertical Drilling Case Study

This case study covers a special case of attitude hold, vertical drilling. Vertical drilling is a more demanding form of attitude control and in this simulation was implemented simply using VTF but with the demand attitude set to have a zero inclination (with arbitrary demand azimuth). It is a demanding form of attitude drilling mainly because of the noisier inclination measurement. However, the simulation demonstrated that the bias unit 40 was able to hold vertical to within ±1.0 degrees.

Less than 100 Percent Steering Ratio ("SW") Case Study

In accordance to aspects the disclosure, the pad-in-bit articulated BHA 10 and RSS 20 can steer with steering ratios less than 100 percent and in modes other than virtual tool face ("VTF") or vertical. This permits the directional drillers to downlink curved sections which are drilled at DLS values less than the maximum the tool can achieve.

This could be a problem for some embodiments of the RSS tool because of the longer dimension from the drill bit to the universal joint to fit in the bias unit, the control unit and possibly a separate D&I sensor to the one on the control unit. This may mean the tool will have a greater tendency to stay at the attitude it had in the bias phase of the drilling cycle whilst in the neutral phase. Conventionally the neutral phase of the drilling cycle is achieved by spinning the actuation tool face open loop at a constant rate as the tool propagates.

However, in accordance with aspects of the disclosure, the pad-in-bit articulated RSS 20 tool presents an additional possibility for the neutral phase of the drilling cycle due to the pad in bit nature of the actuation on the end of the articulated section 25. Rather than spinning the tool face of actuation at a constant open loop rate, the tool phase of actuation can simply be inverted by 180 degrees relative to the tool face in the bias phase whilst in the neutral phase of the drilling cycle.

Because of the far better tool face actuation dynamics, the pad-in-bit articulated RSS 20 will approximate well to drilling on tool face in the bias phase, and 180 degree offset from the demand tool face in the neutral phase. This will mean the in plane curvature of the curved section will approximate well to the difference between the bias and neutral percentages as a percentage of the maximum DLS of the tool. So for example, if the pad-in-bit articulated RSS 20 is capable of 16 degrees/100 ft. then with a 70 percent steering ratio it will respond with a 40 percent (70 percent −30 percent) of maximum DLS (6.4 degrees/100 ft.) for the in plane curved section. Table 2 provides a theoretical range of response percentage of maximum DLS verses percentage steering ratio for an in plane curved section.

TABLE 2

| SR % (percent) | Response % of max DLS (net curvature) |
|---|---|
| 50 | 0 |
| 60 | 20 |
| 70 | 40 |
| 80 | 60 |
| 90 | 80 |
| 100 | 100 |

Hence with this modification to existing drilling practice the pad-in-bit articulated RSS 20 will be able to drill curved sections using the drilling cycle concept with curvatures less than the maximum DLS capability of the tool.

Using a 180 degree tool face inversion on the demand tool face, as described above, for the neutral phase of the drilling cycle is original to the pad-in-bit articulated RSS 20 in accordance to this disclosure. This neutral cycle implementation is only possible for the pad-in-bit articulated RSS 20 concept and is not anticipated to work well or be applicable to standard RSS tools.

A simulation was run of a pad-in-bit articulated RSS 20 drilling at 90 degree GTF at 70 percent SR for the first 80 feet (therefore expected to respond with a 40 percent of maximum tool DLS) and after 80 feet the tool continued to drill with a 100 percent SR until the end of the simulation. The simulation demonstrated that the 70 percent SR section had a DLS approximately 40 percent of the 100 percent SR section, as expected.

Choice of Optimum Drilling Cycle Time for In Plane Curve

The less than 100 percent DLS plane section curve approach previously detailed also lends itself to a simple geometrical analysis such that the drilling cycle time can be chosen for a given set of operating point conditions to give a specified nominal maximum deviation of the instantaneous in plane curve from the ideal in plane curve as if drilled continuously with a drilling cycle of 100 percent steering ratio.

Figure 6:
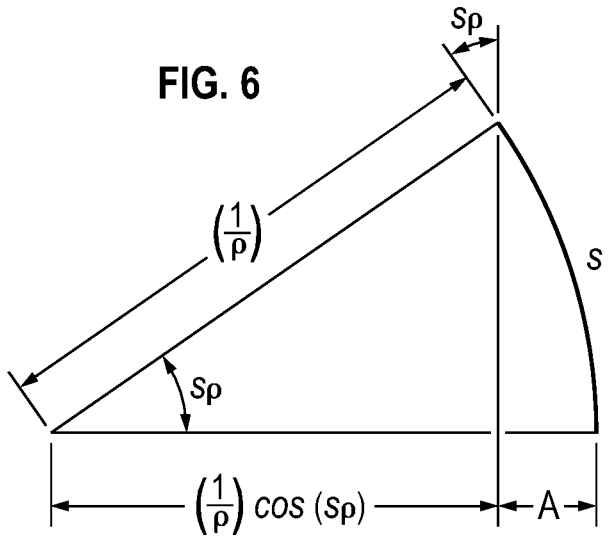
FIG. 6 is a geometric illustration for estimating an optimum drilling cycle time in accordance to one or more aspects of the disclosure.

The starting point for the geometrically based analysis is described with reference to FIG. 6 which finds the lateral deviation of the curve "A" from its starting tangent over a specified path length "s" for a defined dog leg severity (DLS) curvature p.

Hence, it can be deduced that:

$$A = \frac{1 - \cos s\rho}{\rho} \quad \text{(Eq. 4)}$$

Figure 7:
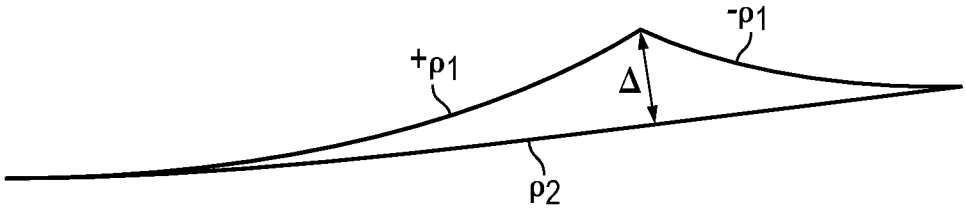
FIG. 7 is a geometric illustration for an instantaneous and net curvature over one drilling cycle.

Therefore the schematic in FIG. 7 can be sketched for the instantaneous and net curvature over one drilling cycle with "bias" curvature $+\rho_1$ and "neutral" curvature $-\rho_1$ for the instantaneous curve (i.e., $\rho_1$) and curvature $\rho_2$ for the net curvature path.

It can be deduced that the deviation $\Delta$ of the instantaneous curve $\rho_1$ from the ideal net curvature curve $\rho_2$ over the drilling cycle, is given by:

$$\Delta = \left[\frac{1 - \cos(\alpha s \rho_1)}{\rho_1}\right] - \left[\frac{1 - \cos(\alpha s \rho_2)}{\rho_2}\right] \quad \text{(Eq. 5)}$$

$$\Delta = \frac{\rho_2 - \rho_1 - \rho_2 \cos(\alpha s \rho_1) + \rho_1 \cos(\alpha s \rho_2)}{\rho_1 \rho_2} \quad \text{(Eq. 6)}$$

Where $\alpha$ is the steering ratio ("SR") and s is the measured depth drilled over the drilling cycle at a nominal rate of penetration Vrop, such that if $\Delta t$ is the drilling cycle period then the measured depth s is given by Vrop·$\Delta t$, and the drilling time is $$\Delta t = \frac{s}{Vrop}.$$

Therefore, with this expression for a given range of steering ratio $\alpha$ values, nominal Vrop and $\rho_1$ for an assumed $\Delta t$ it is possible to estimate the deviation $\Delta$ of the instantaneous in plane curve $\rho_1$ from the equivalent net curvature curve $\rho_2$. Therefore, for an assumed Vrop and $\rho_1$, and $\alpha$ steering ratios, a look up table of drilling cycle $\Delta t$ times can be derived to ensure the instantaneous to net curve deviation $\Delta$ can be kept below a desired nominal value.

Figure 8:
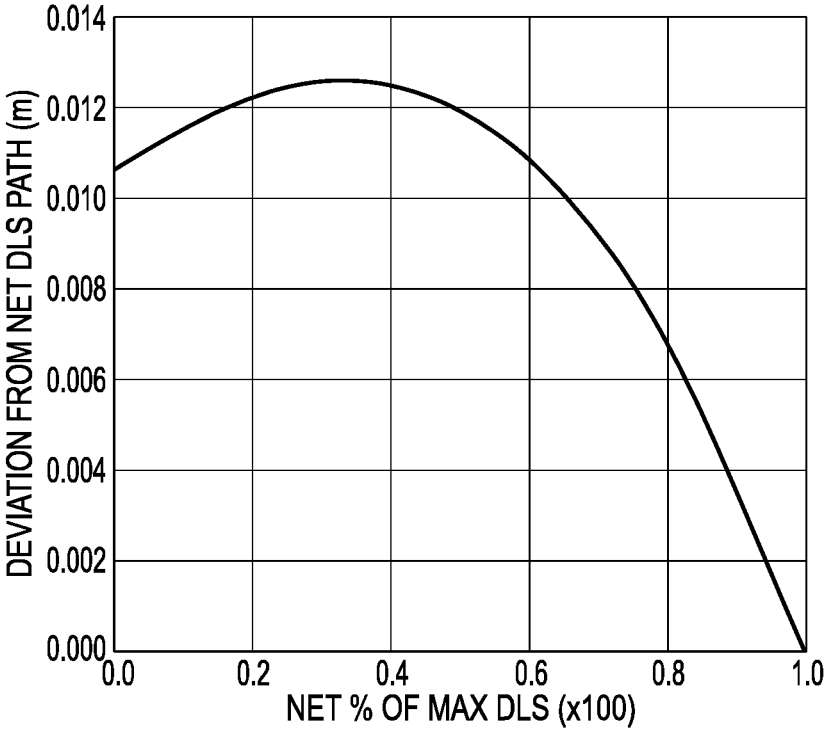
FIG. 8 is a graphically illustration of a variation of the instantaneous to net curve deviation for a drilling cycle in accordance to one or more aspects of the disclosure.

For example the FIG. 8 graph shows the variation of the instantaneous to net curve deviation $\Delta$ for a 180 second drilling cycle, a pad-in-bit articulated RSS 20 tool with a maximum DLS of 16 degree/100 ft. and assumed nominal Vrop of 200 ft./hr. It can be seen that for this operating point the worst case $\Delta$ is just less than 13 mm at a net percentage of maximum DLS of 40 percent, which corresponds to a steering ratio of 70 percent. If this is too much deviation for this operating point then the drilling cycle time can be reduced accordingly, and so on.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for drilling a subterranean wellbore, the method comprising:

(a) generating a net drilling curvature over a single drilling cycle of one bias phase and one neutral phase for drilling the wellbore with a rotary steerable system;

(b) computing an instantaneous curvature of the wellbore, during the single drilling cycle, from a bias curvature of the rotary steerable system deployed in the wellbore and a neutral curvature of the rotary steerable system deployed in the wellbore;

(c) processing the bias curvature, a steering ratio, and a rate of penetration of drilling with the rotary steerable system and computing a deviation of the instantaneous curvature from the net drilling curvature over the single drilling cycle;

(d) choosing a drilling cycle time for cycling between the bias and neutral phases of the rotary steerable system, and by determining the deviation of the instantaneous curvature from the net drilling curvature computed in (c) is less than a maximum deviation for the single drilling cycle; and (e) cycling back and forth between the bias phase and the neutral phase of the rotary steerable system at the drilling cycle time chosen in (d) while rotating the rotary steerable system in the wellbore to drill.

2. The method of claim 1, wherein cycling back and forth between the bias phase and the neutral phase comprises cycling back and forth between drilling the bias phase on a demand tool face and drilling the neutral phase on a 180 degree offset tool face from the demand tool face.

3. The method of claim 1, wherein the rotary steerable system comprises:

an upper stabilizer connected to a collar of a drill string;

an articulated section connected by a flexible joint to the collar;

a drill bit connected to the articulated section opposite from the flexible joint;

a lower stabilizer located proximate to the flexible joint; and an actuator located with the articulated section and selectively operable while drilling to tilt an axis of the drill bit and the articulated section relative to a collar axis.

4. The method of claim 3, wherein cycling back and forth between the bias phase and the neutral phase comprises cycling back and forth between drilling the bias phase on a demand tool face and drilling the neutral phase on a 180 degree offset tool face from the demand tool face.

5. The method of claim 4, wherein the actuator is located adjacent to the drill bit and the flexible joint permits two angular degrees of freedom whilst allowing for transmission of axial torque to the drill bit and transmitting a negligible bending moment across itself.

6. The method of claim 1, wherein the deviation of the instantaneous curvature from the net drilling curvature is computed in (c) according to the following mathematical equation:

$$\Delta = \frac{\rho_2 - \rho_1 - \rho_2\cos(\alpha \cdot s \cdot \rho_1) - \rho_1\cos(\alpha \cdot s \cdot \rho_2)}{\rho_1 \cdot \rho_2}$$

wherein $\Delta$ represents the deviation of the instantaneous curvature from the net drilling curvature over the single drilling cycle, $\rho_1$ represents the bias curvature of the rotary steerable system, $\rho_2$ represents the net drilling curvature, $\alpha$ represents the steering ratio, and s represents a measured depth drilled during the single drilling cycle of the bias phase and the neutral phase, wherein s is given by the rate of penetration of drilling times the drilling cycle time.

7. The method of claim 1, wherein:

(d) further comprises:

computing a lookup table of the deviations of the instantaneous curvature from the net drilling curvature and corresponding drilling cycle times from the bias curvature of the rotary steerable system, assumed rates of penetration, and a plurality of the steering ratios over the single drilling cycle; and (ii) choosing the drilling cycle time from the lookup table.

8. The method of claim 7, wherein computing the lookup table includes generating at least one graph of the deviation of instantaneous curvature from the net drilling curvature as a percentage of maximum dog leg severity, each graph of the at least one graph being specific to a particular drilling cycle time.

* * * * *